United States Patent [19]

Rushing et al.

[11] Patent Number: 4,827,680

[45] Date of Patent: May 9, 1989

[54] ABRASIVE CLEANING DEVICE AND METHOD

[75] Inventors: Larry D. Rushing, Stafford; Douglas W. McFadden, Missouri, both of Tex.

[73] Assignee: Tuboscope Inc., Houston, Tex.

[21] Appl. No.: 139,574

[22] Filed: Dec. 30, 1987

[51] Int. Cl.[4] ..... B24C 5/04

[52] U.S. Cl. ..... 51/439; 51/411; 51/321; 239/419.3

[58] Field of Search ..... 51/439, 410, 427, 319, 51/320, 321, 411; 239/419.3, 418, 419, 591, 426

[56] References Cited

U.S. PATENT DOCUMENTS

| | | | |
|---|---|---|---|
| 3,427,763 | 2/1969 | Maasberg | 51/411 |
| 3,972,150 | 8/1976 | Hart | 51/439 |
| 4,125,969 | 11/1978 | Easton | 51/439 |
| 4,341,350 | 7/1982 | Wemmer | 239/419 |
| 4,449,332 | 5/1984 | Griffiths | 51/439 |
| 4,633,623 | 1/1987 | Spitz | 51/439 |

FOREIGN PATENT DOCUMENTS

| | | | |
|---|---|---|---|
| 0893086 | 5/1944 | France | 51/439 |
| 0159373 | 7/1986 | Japan | 51/439 |
| 0814698 | 3/1981 | U.S.S.R. | 51/439 |
| 0626074 | 7/1949 | United Kingdom | 51/439 |

*Primary Examiner*—Frederick R. Schmidt
*Assistant Examiner*—Robert A. Rose
*Attorney, Agent, or Firm*—Finnegan, Henderson, Farabow, Garrett & Dunner

[57] ABSTRACT

An abrasive cleaning device that includes a nozzle assembly and method wherein a low pressure stream of abrasive particles and gas, and a high pressure stream of liquid are provided. These streams intersect an an angle sufficient to entrain the abrasive particles within the high pressure liquid stream. The abrasive particles are directed into contact with a surface to be abraded. The intersecting of the streams occurs outside the nozzle assembly.

16 Claims, 2 Drawing Sheets

ABRASIVE CLEANING DEVICE AND METHOD

BACKGROUND OF THE INVENTION

1. Field of the Invention

The invention relates to an abrasive cleaning device and method for cleaning using a water jet in which abrasive particles are entrained.

2. Description of the Prior Art

For the cleaning or abrading of surfaces it is known to use devices and methods that deliver particles of an abrasive material. These devices have a nozzle through which a gas or liquid stream is directed, which stream has the abrasive particles entrained therein. Devices of this type are also known wherein two streams are mixed with one having particles and the other having a liquid to form the jet of abrasive particles entrained in liquid for cleaning.

With prior-art devices and methods of this type, it has heretofore been impossible to achieve a combination of the high jet velocity required for effective cleaning, a compact structure that may be easily manipulated and used for cleaning closely confined areas such as the interior of pipe or tubing, and resistance to rapid deterioration caused by the high velocity abrasive particles passing through the device during use. In devices of this type where the jet with the entrained abrasive particles passes through the nozzle at high velocity or is mixed within the nozzle with a liquid carrier stream, excessive wear of the nozzle results. In devices wherein the particles are mixed outside the nozzle, the required compactness for easy manipulation and use in cleaning confined areas, such as pipe and tubing, cannot be achieved.

SUMMARY OF THE INVENTION

It is accordingly a primary object of the present invention to provide an abrasive cleaning device and method that has, in combination, a high velocity fluid jet having entrained abrasive particles for effective cleaning, compactness for use in confined areas, and resistance to wear and deterioration from abrasive particles passing through the device during use thereof.

The abrasive cleaning device of the invention comprises a unitary nozzle assembly including first means for supplying an axial, relatively low pressure stream of abrasive particles and gas. Second means are provided for applying a relatively high pressure stream of liquid in a direction within the unitary nozzle assembly forming an acute angle relative to the axis of the low pressure stream of abrasive particles and gas. These first and second means are provided within the unitary nozzle assembly. The high pressure stream intersects the low pressure stream at an angle sufficient to entrain the abrasive particles within the high pressure stream and at a velocity sufficient to direct the abrasive particles into contact with the surface to be cleaned or abraded. The intersecting of the high and low pressure streams occurs outside the unitary nozzle assembly to thereby form an abrasive jet.

The unitary nozzle assembly includes a protective sheath surrounding and enclosing the aforesaid first and second means. The high and low pressure stream intersect at an acute angle at a location outside the unitary nozzle assembly. The low pressure stream of abrasive particles and gas flows axially through the nozzle assembly. The high pressure stream constitutes a major volume and the low pressure stream constitutes a minor volume of the abrasive jet. The gas of the low pressure stream may be air and the liquid of the high pressure stream may be water. The high pressure stream of water may be within the pressure range of 10,000 to 25,000 psi. The second means for supplying the relatively high pressure stream of liquid includes a liquid nozzle removably secured within the unitary nozzle assembly. This nozzle is directed at an acute angle relative to the axis of the low pressure stream of abrasive particles and gas. The means for supplying the axial low pressure stream of abrasive particles includes a tubular insert within the unitary nozzle assembly. The tubular insert is in substantial axial alignment with the source of a low pressure stream of abrasive particles.

The method of the invention comprises supplying a first, axial, relatively low pressure stream of abrasive particles and gas. A second, relatively high pressure stream of liquid is supplied with the first and second streams intersecting at an angle sufficient to entrain the abrasive particles within the high pressure stream at a velocity sufficient to direct the abrasive particles into contact with a surface to be abraded. The first and second streams intersect at an acute angle. The first stream flows axially through nozzle assembly. The second high pressure stream constitutes a major volume and the low presure stream constitutes a minor volume of the abrasive cleaning jet. The gas of the first low pressure stream may be air and the liquid of the second high pressure stream may be water. The high pressure water stream may be within the pressure range of 10,000 to 25,000 psi. The first and second streams are supplied through coextensive, unitary nozzles enclosed in a protective sheath.

BRIEF DESCRIPTION OF THE DRAWINGS

The accompanying drawings, which are incorporated in and constitute a part of this specification, illustrate an embodiment of the invention and, together with the description, serve to explain the principles of the invention.

Figure 1:
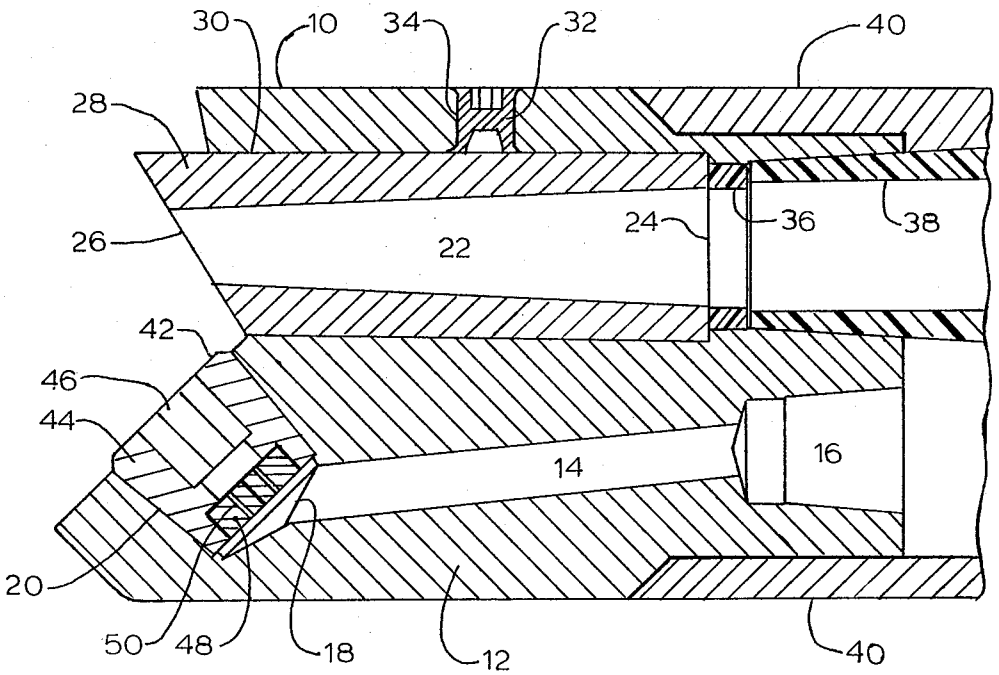
FIG. 1 is an elevational view of one embodiment of the abrasive cleaning device of the invention in cross-section.
Figure 2:
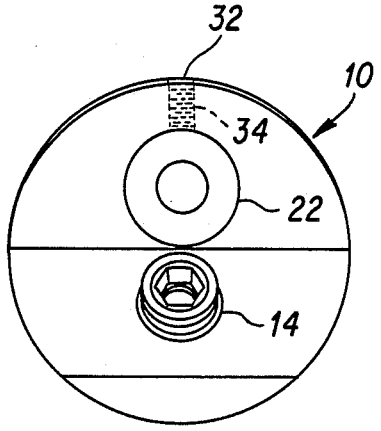
FIG. 2 is a front view of the device of FIG. 1.

With reference to the drawings, there is shown in FIGS. 1 and 2 thereof an abrasive cleaning device constituting a unitary nozzle assembly, designated generally as 10. The unitary nozzle assembly 10 includes a nozzle body 12. The nozzle body 12 has a bore 14 connected at one end 16 to a source of high pressure water (not shown) and an opposite end 18 opening into an angled, annular cavity 20. Coextensive with the bore 14 is a second tapered bore 22 having an end 24 connected to a source of an air-abrasive particle stream (not shown). An opposite end 26 of the bore 22 constitutes a discharge end from the nozzle assembly 10. The bore 22 is within sleeve 28 housed within longitudinal cavity 30 of the nozzle body 12. Th sleeve 28 is secured within the longitudinal cavity 30 by set screw 32 extending through opening 34 of the nozzle body 12 and into contact with the sleeve 28.

A nylon washer 36 defines a connection between the end 24 and a flexible hose 38 connected to the source of the air-abrasive particle stream (not shown).

A protective sheath 40, which may be of a rubberized material or rigid, metal conduit is provided over a portion of the nozzle body 12 and extends over the ends 16 and 24 of the bores 14 and 22, respectively.

A water jet nozzle 42 is positioned within the cavity 20 and communicates therein with the bore 14 connected to the source of high pressure water (not shown). The nozzle 42 includes an annular body portion 44 having a central discharge chamber 46 opening to the outside of the nozzle assembly. At the base of the chamber 46 is an annular insert 48 having three tapered passages 50 communicating with the chamber 46 and the bore 14.

During operation of the nozzle assembly, a mixture of air and entrained abrasive particles passes through the bore 22 and is intersected at an acute angle with high pressure water from the water nozzle 42. The axis of the nozzle 42 is directed generally toward the surface to be abraded. The water issuing from the nozzle 42 entrains the particles and directs them onto the surface to be cleaned.

The protective sheath 40 provides for easy handling of the nozzle assembly and protects the same from damage during use. In addition, the protective sheath protects an operator from injury should rupture of the high pressure water source occur. The high pressure water source comprises a hose (not shown) connected to the bore 14 of the nozzle body 12.

As may be seen from the above-described embodiment of the invention, the unitary nozzle assembly thereof constituting the abrasive cleaning device provides the required high pressure water jet or stream with entrained abrasive particles necessary for cleaning without mixing of the water and abrasive particles within the nozzle assembly to cause undue wear and deterioration thereof. The water and abrasive particles are mixed outside the nozzle assembly and yet a unitary nozzle assembly is provided for this purpose to achieve the desired compactness for ease of handling during use. This is further facilitated by the use of the protective sheath in combination with the unitary nozzle assembly. In this manner, handling of the device during use is further facilitated and the nozzle assembly and associated high pressure water source are protected against damage. This also contributes to the safety of the device during operation. The use of the replaceable water jet nozzle enables nozzles of various configurations to be employed so that any desired configuration for the water jet may be used by merely interchanging nozzles. This replacement of the water jet nozzle may be achieved without requiring disassembly of the overall device. This facilitates field use and repair.

By the use of a sleeve for defining the bore or passage through which the abrasive particles pass, this component may be replaced upon wear or damage with the remainder of the nozzle being retained for continued use. This contributes to the low cost construction of the nozzle assembly and its ease of use in field application.

What is claimed is:

1. An abrasive cleaning device, comprising a unitary nozzle assembly having a central, longitudinal axis and adapted for use within closely confined areas, such as the interior of pipe or tubing, said nozzle assembly including first means for supplying an axial, relatively low pressure stream of abrasive particles and gas, liquid supply means for introducing liquid into said nozzle assembly at an acute angle to second means for supplying a relatively high pressure stream of said liquid in a direction within said unitary nozzle assembly forming an acute angle relative to the axis of said low pressure stream of abrasive particles and gas with said first and second means being disposed on opposite sides of said axis, said high pressure stream intersecting said low pressure stream at an unenclosed area outside said nozzle assembly and at an acute angle sufficient to entrain said abrasive particles within said high pressure stream and at a velocity in combination with said acute angle sufficient to form said abrasive particles into an abrasive jet directed nonaxially with respect to said nozzle assembly into contact with a surface to be abraded.

2. The device of claim 1 wherein said unitary nozzle assembly further includes a protective sheath surrounding and enclosing at least a portion of said first and second means.

3. The device of claim 2 wherein said low pressure stream of abrasive particles and gas flows axially through said nozzle assembly.

4. The device of claim 3 wherein said high pressure stream constitutes a major volume and said low pressure stream constitutes a minor volume of said abrasive jet.

5. The device of claim 4 wherein said gas of said low pressure stream is air.

6. The device of claim 5 wherein said liquid of said high pressure stream is water.

7. The device of claim 6 wherein said high pressure stream of water is within the pressure range of 10,000 to 25,000 psi.

8. The device of claim 4 wherein said second means for supplying said relatively high pressure stream of liquid includes a liquid nozzle removably secured within said unitary nozzle assembly and having a liquid discharge chamber opening outside said nozzle assembly and from which said relatively high pressure stream of liquid is discharged.

9. The device of claim 8 wherein said means for supplying said axial, low pressure stream of abrasive particles includes a tubular insert within said unitary nozzle assembly, said tubular insert being connected in axial alignment with a hose extending from a source of said low pressure stream of abrasive particles at a longitudinal area having an inside diameter substantially equal to inside diameters of said tubular insert and said hose.

10. A method for producing an abrasive cleaning jet within a closely confined area, such as the interior of a pipe or tubing, said method comprising supplying from a nozzle assembly having a central longitudinal axis and positioned within said confined area a first axial, relatively low pressure stream of abrasive particles and gas, supplying a second relatively high pressure stream of liquid with said first and second streams issuing from said nozzle assembly from opposite sides of said axis and with said first and second streams intersecting at an acute angle within said confined area and outside said nozzle assembly sufficient to entrain said abrasive particles within said high pressure stream to form said abrasive cleaning jet and direct said jet at an acute angle into contact with a surface of said confined area to be abraded.

11. The method of claim 10 wherein said first stream flows axially through a nozzle assembly.

12. The method of claim 10 wherein said high pressure stream constitutes a major volume and said low pressure stream constitutes a minor volume of said abrasive cleaning jet.

13. The method of claim 12 wherein said gas of said first low pressure stream is air.

14. The method of claim 13 wherein said liquid of said second high pressure stream is water.

15. The method of claim 14 wherein said second high pressure stream of water is within the pressure range of 10,000 to 25,000 psi.

16. The method of claim 15 wherein said first and second streams are supplied through coextensive, unitary nozzles enclosed in a protective sheath.

* * * * *